United States Patent [19]

Fester et al.

[11] Patent Number: 4,507,257

[45] Date of Patent: Mar. 26, 1985

[54] PROCESS FOR PREPARING ACRYLIC FILAMENTS AND FIBERS

[75] Inventors: Walter Fester, Königstein; Bernd Huber, Kelheim; Lieselotte Wappes, Frankfurt am Main, all of Fed. Rep. of Germany

[73] Assignee: Hoechst Aktiengesellschaft, Fed. Rep. of Germany

[21] Appl. No.: 472,859

[22] Filed: Mar. 7, 1983

[30] Foreign Application Priority Data

Mar. 18, 1982 [DE] Fed. Rep. of Germany ..... 3209796

[51] Int. Cl.[3] ..... D01F 6/18; D01F 6/00

[52] U.S. Cl. ..... 264/78; 8/115.5; 8/115.6; 428/253; 264/182; 264/184; 264/206

[58] Field of Search ..... 264/182, 184, 28, 29.2, 264/78, 206; 8/115.5, 115.6; 428/253

[56] References Cited

U.S. PATENT DOCUMENTS

| | | | |
|---|---|---|---|
| 3,242,000 | 3/1966 | Lynch | 8/115.5 |
| 3,273,956 | 9/1966 | Fujita et al. | 8/115.5 |
| 3,281,261 | 10/1966 | Lynch | 264/29.2 |
| 3,406,145 | 10/1968 | Hennes | 8/115.5 |
| 3,468,841 | 9/1969 | Corbiere et al. | 264/182 |
| 3,681,004 | 8/1972 | Torrance | 264/182 |
| 3,733,386 | 5/1973 | Shimoda et al. | 264/182 |
| 3,917,776 | 11/1975 | Sato et al. . | |
| 4,267,233 | 5/1981 | Tanaka et al. | 428/253 |
| 4,378,226 | 3/1983 | Tomibe et al. | 8/115.5 |

FOREIGN PATENT DOCUMENTS

| | | | |
|---|---|---|---|
| 37-3920 | 6/1962 | Japan | 264/182 |
| 49-35629 | 4/1974 | Japan | 264/182 |
| 56-148965 | 11/1981 | Japan | 8/115.5 |
| 1397620 | 6/1975 | United Kingdom . | |
| 914666 | 3/1982 | U.S.S.R. | 264/182 |

*Primary Examiner*—Donald Czaja
*Assistant Examiner*—Hubert C. Lorin
*Attorney, Agent, or Firm*—Connolly and Hutz

[57] ABSTRACT

The invention relates to a process for preparing wet- or dry-spun filaments and fibers of polymers which consist to more than 50% by weight of acrylonitrile units and which are continually treated with an aqueous solution containing copper(I) ions during the fiber production process but before a first heat treatment above 100° C. and the copper content in the fibrous material is fixed by heating to above 60° C., preferably to above 100° C. The filaments and fibers thus obtained can be dyed with acid dyestuffs, have bactericidal properties, and can be subjected to accelerated pre-oxidation.

8 Claims, No Drawings

PROCESS FOR PREPARING ACRYLIC FILAMENTS AND FIBERS

The invention relates to a process for preparing acrylonitrile-containing fibers and filaments using a dry- or wet-spinning method where fibers or filaments not yet "cured" by drying or a heat treatment above 100° C. are continually treated with an aqueous solution of copper(I) ions.

It is known to treat acrylic fibers with copper(II) salts in order to obtain a bactericidal effect (cf. Japanese Preliminary Published Application 54-147,220). It is also known to incorporate copper(II) salts by spinning, with the same object, and as a catalyst for the oxidation of such filaments in the production of carbon fibers (Japanese Preliminary Published Application 49-035,629).

The treatment of acrylic fibers with copper(I) salts, to render them dyeable with acid dyestuffs, was only used in the early days of acrylic fiber processing, as the so-called cuprous ion dyeing method. This work is described in summary by, for example, Rath et al. in "Melliand Textilberichte", 38, (1957), pages 431 to 435 and 538 to 542. More recently Japanese Preliminary Published Application 51-90,387 described aftertreating of moldings with copper(I) salts to catalyze the pre-oxidation when thermostabilizing these products.

The reaction of copper(I) salts with polymers which contain acrylonitrile components gives a cuprous ion complex with the nitrile groups of the polyacrylonitrile. However, reacting copper(I) salts with polyacrylonitrile after it has been shaped into structures is extremely involved and, due to the instability of copper(I) salts in aqueous solutions, in particular at elevated temperatures, cannot be carried out to give reproducible results. The treatment of polyacrylonitrile powders with solutions of copper(I) salts leads to products which are insoluble in the known solvents for polyacrylonitrile, or gel-like unspinnable materials form. If, for example, copper(I) salts are added to a prepared spinning dope, the dope starts to gel and can no longer be spun in faultfree fashion while the extrusion of spinning compositions containing copper(I) salts into injection-molded articles may still not be prevented.

There was thus still the unsolved object of preparing copper(I)-containing acrylonitrile polymers in a reliable, simple and continuous manner as part of the production process, to obtain copper(I)-containing filaments and fibers which, for example, are suitable for dyeing with anionic dyestuffs.

It has been found, surprisingly, that tows or bundles of filaments which contain acrylonitrile components in their fiber-forming substance absorb even at room temperature relatively large amounts of copper(I) ions from treatment baths provided these bundles or tows had not yet been subjected to a heat treatment above 100° C. or to a drying process. The absorption of copper(I) ions takes place within seconds, and can therefore be integrated without difficulties into the process for producing acrylonitrile-containing filaments and fibers. It is quite immaterial whether the filaments were produced using a dry- or a wet-spinning method. The absorption of copper(I) ions takes place particularly readily in the case of wet-spun filaments, but it is also possible to load copper(I) ions onto dry-spun but still solvent-containing filaments within the wash process or aftertreatment prooess. According to the amount of copper(I) desired in the fiber the treatment can be carried out before, during, or after the bundles or tows have been washed. The copper(I) content in the filaments can of course also be affected by the length of the treatment time and the concentration in the bath liquid.

The absorption of copper(I) ions from a bath or from a spray section at room temperature is largely a reversible step, i.e. it is possible to remove the copper content by subsequent washes. For this reason it is necessary to ensure that the copper content is fixed in the fiber. This fixing can be effected by means of a heat treatment above about 60° C., preferably above 85° C., or by means of a drying step in which correspondingly high temperatures are also exceeded.

The temperature is not the only important parameter in the fixing process, the other being the dwell time. While fixing at, for example, 65° C. requires prolonged dwell times, the same effect can be obtained at temperatures above 100° C. in a minute or markedly less. If the absorption of copper(I) ions takes place from a bath at a temperature higher than about 60° C., the copper(I) ions are simultaneously fixed in the polymer molecule.

After such a heat treatment the copper(I) content can no longer be washed out, presumably because under these conditions the copper(I) ions have been incorporated in the form of complexes in the polyacrylonitrile.

In a conventional procedure, the tow or the bundles are pulled through a bath containing copper(I) ions, substantially squeezed to remove excess bath liquid, and passed, for example, over hot godets having a surface temperature of, for example, 100° C. Thereafter a further wash can be provided to remove from the filaments copper salts and the like adhering to the surface, and a customary spin finish can be applied in a subsequent bath before the filaments are finally dried.

However, it is also possible to treat the tows directly before the first drying stage with a copper(I) ion solution and to fix the ions concurrently with the drying stage. In this case the surface of the filaments does not have complexed copper compounds which can be dissolved off through a first contact with water. Instead of using heated godets or rolls it is also possible to carry out the heat treatment to fix the copper content in a steam atmosphere, for example at temperatures above 95° C., or with the use of infrared radiators or by passing the fiber through a contact heat section.

In all cases the treatment medium is an aqueous solution of copper(I) salts. Such a solution can be prepared in various ways. The following possibilities are mentioned as examples:

An appropriate solution can be obtained by dissolving copper(I) salts, for example CuCl, in water, but because of the poor solubility of these salts it is advantageous to prepare the solutions in 20 to 50% strength sodium chloride solutions.

A copper(I) ion solution can also be generated directly, by reducing copper(II) solutions electrolytically or by heating copper(II) salt solutions in the presence of metallic copper, which is added in the form of a powder or can be generated by electrolysis.

The solution can also be prepared by mixing a copper(II) salt solution with a reducing agent. The copper salt $CuSO_4 \times 5\ H_2O$ has proved particularly suitable in this method for use as the customary copper(II) salt.

Of the many possible reducing agents aldehyde sulfoxylates, and of these in particular the sodium salt of hydroxymethanesulfinic acid, have been found to be particularly suitable, since highly stable high copper(I)

ion concentrations can be obtained by means of this system. The stability can be increased still further by means of suitable complexing agents. The low temperatures required of the aqueous solutions contribute significantly to the stability of the copper(I) solutions. In contrast to the old cuprous ion method, which was carried out at the boil, a temperature in the proximity of room temperature is virtually sufficient in almost all cases. Temperatures slightly above room temperature, i.e. temperatures of, for example, 25°-30° C., may be used, since in this method the temperature constancy of the bath can be ensured by very simple technical means. Since the stability of copper(I) solutions is only guaranteed for brief times, even at room temperature, the following procedure has been found to be particularly suitable:

In this method, a copper(II) salt solution in water and an aqueous solution which contains the reducing agent are separately metered into the bath, in the vicinity of the point where the tow enters, and are mixed in the bath. In this way it is possible to ensure that the tow is always treated with fresh copper(I) solution. The tow and the bath liquid are in parallel flow, excess bath liquid, which preferably is largely spent, is drawn off the trough in the vicinity of the point where the tow exits, and, for example, returned after having been replenished.

The concentration of the copper(I) ions can vary within wide limits, according to the fiber properties desired. If the copper(I) solution is prepared by reducing copper(II) compounds, the reducing agent must be used in at least the stoichiometric amount. The reduction is preferably carried out with a slight excess, in order to avoid the presence of copper(II) salts. Unlike copper(I) compounds copper(II) ions cannot be complexed by the polymer molecules, and they are thus washed out in subsequent washes or dyeing processes and pollute the effluent. A pronounced excess of reducing agents does not in general yield further benefits. On the contrary, there is the danger of the copper(I) compound being reduced further, to give metallic copper, which can then no longer be incorporated into the filaments or fibers. An apparent exception to this are the aldehyde sulfoxylates, where at room temperature even a relatively large excess does not increase the degree of copper deposition.

The process according to the invention can employ the industrially customary methods for producing polyacrylonitrile fibers and filaments. As already mentioned above, the wet-spinning method yields particular benefits, since, in general, copper(I) ions diffuse more readily into wet-spun filaments than into dry-spun filaments.

The copper(I) ion solution can be applied by various known methods, thus, for example, by passing the tow or bundles through a bath. However, it is also possible to apply the solution using spray sections or the like. It is advantageous to squeeze the tow or bundles very thoroughly before and after the treatment with the aqueous copper(I) ion solution. In this way it is ensured that the degree of carry-over of copper ions into other baths and the unnecessary dilution of the copper(I) ion treatment bath remain within tolerable limits. It is of course advantageous to take measures which ensure efficient and uniform penetration of a tow or bundle in the treatment liquor. For example, tows should be passed into the treatment bath in a state sufficiently wide to ensure that depletion of copper ion concentrations or retarded penetration of the treatment bath into the interior of the tow can ideally be neglected.

As already stated above, it is necessary to fix the copper(I) ions in the filament or fiber material by means of a thermal treatment. Only after the fiber has been heated to temperatures above 60° C., preferably above about 100° C., does the desired complex formation take place within a brief time, and the copper compounds can no longer be removed from the treated fiber material by means of a wash. A wash subsequent to the heat treatment of course washes off the quantity of copper compounds which was present at the surface of the filament material and could not be fixed.

The treatment with copper(I) compounds renders the acrylic fibers thus treated more heat-sensitive than untreated filaments. The temperatures at which the heat treatment or drying is carried out must be chosen in such a way that a good white is retained.

The acrylonitrile-containing polymers used are understood as meaning those polymers of which more than 50%, preferably more than 85%, consists of acrylonitrile units. Examples of suitable further components are acrylic acid, methacrylic acid and their esters and amides, vinyl acetate, vinyl chloride, vinylidene chloride, vinylidene cyanide and other unsaturated compounds which can be copolymerized with acrylonitrile. Filaments and fibers prepared according to the invention can be used for many different purposes.

Thus, for example, gently dried fibers, which still have a good white, can be dyed with acid dyestuffs, have bactericidal properties, and can even be subjected to accelerated pre-oxidation for the production of carbon fiber.

The good dyeability with anionic dyestuffs can also be utilized to carry out the dyeing already at the fiber production stage. Today acrylic fibers are customarily dyed with cationic dyestuffs. This is true not only of batchwise dyeing of fully prepared fiber but also of gel dyeing where undried fiber is dyed in the gel state during its production process. Although cationic dyestuffs already have high light fastness properties on acrylic fibers, there are many shades where the fastness properties of a dyeing with anionic dyestuffs, as, for example, obtainable using the old cuprous ion process, cannot be reached. This is the reason why end uses where high demands are made on the light fastness, such as, for example, fibers for awnings, make use of spin dyeing with expensive pigments.

The process described above gives filaments and fibers which can be dyed with anionic dyestuffs without the problems of the old cuprous ion process, but customary dyeing times and conditions must be adhered to.

It has now been found that it is possible to carry out the dyeing process before the first drying stage or the first heat treatment at elevated temperatures. In contrast to normal dyeing processes, this method achieves even deep dyeings at low temperatures and during dwell times of a few seconds. The dyeing liquor used in this process can be used concurrently with the copper(I) ion solution or it can be applied in a separate bath after the treatment with copper(I) salt solution.

If reducing agents are used to generate the copper(I) ion solution care must of course be taken to ensure that the reducing agents used do not destroy the added dyestuff. The separate treatment with a copper(I) salt solution and thereafter with a dye bath permits the dye bath to be changed more rapidly than in the concurrent treatment. On the other hand, it must be appreciated that the normal treatment of tows or bundles with a copper(I) salt solution at room temperature does not immediately bind the copper in complexed form, and the copper can thus be dissolved out again in a subsequent dye bath. However, suitable temperature control makes it possible in many cases to obtain a certain degree of fixation of the copper in the fiber even without irreversibly damaging the gel structure which is still present in the filament. An intermediate heat treatment at temperatures below 100° C. can thus lead to an adequate degree of incorporation of copper in the complexed state while the gel structure is still adequately preserved, to ensure dyeing with anionic dyestuffs within times so brief as to enable the continuous production of dyed filaments or fibers.

The examples which follow illustrate the invention in more detail. Unless otherwise indicated parts are parts by weight and percentages are percentages by weight.

EXAMPLE 1

A 17% strength solution of an acrylonitrile polymer in dimethylformamide was spun in a known way using the wet-spinning method. The polymer used consisted to 99.5% of acrylonitrile and to 0.5% of methyl acrylate and had a relative viscosity, $\eta$ rel., of 2.9. The viscosity was measured on 0.5 percent strength by weight solutions in dimethylformamide at 25° C. The temperature of the dope was 90° C., and a 300-hole jet was used which had a hole diameter of 80 $\mu$m. The spin bath had the following properties:

50% of dimethylformamide
50% of water
Temperature: 50° C.

The freshly spun filaments were taken out of the coagulation bath at a speed of 4 m/min, subjected to a wet stretch at 85° C. of 1:4.05 in a bath which consisted to 60% of dimethylformamide and to 40% of water, and then washed with water at 30° C. until solvent-free. After the washing step the filament band was squeezed to remove the majority of water and passed through a trough which contained an aqueous solution of 100 g/l $CuSo_4 \times 5\ H_2O$ and 20 g/l sodium salt of hydroxymethanesulfinic acid ($CH_2SO_2\ Na \times 2\ H_2O$) (trade name: (R)Rongalit C) (dwell time 1.5 seconds). The solution also contained the necessary spin finish. The solution was replenished by continually metering in an aqueous solution of 200 g/l $CuSO_4 \times 5\ H_2O$ and an aqueous solution of 40 g/l reducing agent. The two solutions were mixed shortly before entry into the treatment trough. The treatment bath had a temperature of 20° C. The copper sulfate solution required for replenishing the bath also contained the necessary spin finish.

After the tow had passed through the trough, it was squeezed again, then dried on two heated godets at 140° C., then subjected to a stretch of 1:1.12 on two heated godets at 160° C., then subjected to a further stretch of 1:1.54 on two further heated godets having a surface temperature of 160° C., and then passed over a cold take-up element, to be wound up. The filaments obtained had a good white and high affinity for acid dyestuffs. The copper content of the fibers was 4.5% of Cu. The following textile values were determined:

Filament titer: 2.9 dtex
Tensile strength: 25 cN/tex
Elongation at break: 10%.

EXAMPLE 2

Fiber was spun as in Example 1, except that the polymer used consisted to 94.5% of acrylonitrile, to 5% of methyl acrylate and to 0.5% of sodium methallylsulfonate. The relative viscosity of the polymer was 1.92. The dope used contained 26% of polymer in dimethylformamide, and was spun at a temperature of 80° C. The coagulation, washing and wet stretch conditions were equal to those in Example 1. The stretch ratio on the hot rolls at 160° C. was chosen to be 1:1.25. The concentration of the copper treatment bath and the temperature also corresponded to those of Example 1. The fibers obtained had a good white and high affinity for acid dyestuffs. The copper content of these fibers was 3.2%, and they had the following textile values:

Filament titer: 2.9 dtex
Tensile strength: 20 cN/tex
Elongation at break: 10%.

EXAMPLE 3

A spinning material as in Example 1 was spun through a 300-hole jet. Each of the jet holes had a diameter of 60 $\mu$m. A mixture of 61% of dimethylformamide and 39% of water, at 50° C., were used as the spin bath. The freshly spun filaments were taken out of the coagulation bath at a speed of 7 m/min, subjected to a wet stretch at 99° C. of 1:2.85 in a bath which consisted to 62% of dimethylformamide and to 38% of water, and then washed with water at 80° C. until solvent-free. After the wash step the tow was squeezed to remove a large proportion of the water, and passed through a trough which contained an aqueous solution of 29 g/l $CuSO_4 \times 5\ H_2O$ and 5.7 g/l of the sodium salt of hydroxymethanesulfinic acid ($CH_2\ SO_2\ Na \times 2\ H_2O$) (dwell time: 1.5 seconds). This bath also contained the necessary spin finish constituents. The solution was metered in as in Example 1. After it had passed through the trough the tow was squeezed again, then dried on two heated godets at 140° C., then subjected to a stretch of 1:1.14 on two heated godets at 160° C., and then drawn off the last heated godet on to a cold take-up element with a further stretch of 1:1.9. The fibers obtained had a copper content of 1.6% and good dyeability with acid dyestuffs. The measured textile values were Filament titer: 2.9 dtex
Tensile strength: 24 cN/tex
Elongation at break: 10%.

EXAMPLE 4

The spin of Example 3 was repeated, except that the treatment solution consisted of an aqueous solution of 50 g/l $CuSO_4 \times 5\ H_2O$ and 4 g/l metallic copper powder. In this case the treatment temperature was 85° C. Care was taken during the spin to ensure that the metallic copper content in the treatment bath was also kept at a constant value. The fiber obtained had a copper content of 2.1% and good dyeability with acid dyestuffs. The textile data of this fiber were Filament titer: 2.9 dtex
Tensile strength: 23 cN/tex
Elongation at break: 12%.

EXAMPLE 5

The spin of Example 1 was repeated, except that the anionic dyestuff Acid Blue 41 (Color Index No. 62,130) was added to the $CuSO_4$ solution. The dyestuff concentration was chosen in such a way that a concentration of 20 g of dyestuff/liter was maintained in the treatment bath.

The dyed filaments obtained were deep blue. The dyestuff which had gone on to the fiber could no longer be removed by, for example, a wash at 60° C.

What is claimed is:

1. A process for preparing dry- or wet-spun filaments or fibers of improved dyeability from polymers comprising more than 50% by weight acrylonitrile units, comprising the steps of:

obtaining, from spinning, a filament bundle or tow, continually treating the filament bundle or tow with an aqueous solution containing copper (I) ions during the fiber production process but before the first drying stage a first heat treatment above 100° C. so that a gel structure is preserved prior to the copper(I) treatment;

fixing the copper content in the thus-treated bundle or tow concurrently or by means of a subsequent heating to a temperature above about 60° C., provided that the concurrent or any subsequent heating is limited to temperatures at which whiteness of the filaments or fibers is substantially retained and the copper (I) ions remain in a dyeability-improving state.

2. The process as claimed in claim 1, wherein said fixing step is carried at a temperature above about 100° C.

3. The process as claimed in claim 1, wherein the solution containing copper(I) ions is at room temperature and the copper content is fixed by means of an immediately subsequent heat treatment.

4. The process as claimed in claim 1, wherein the copper(I) ion concentration in the creatment solution is 0.1 to 50 g/l.

5. The process as claimed in claim 1, wherein the filament bundles or tows are subjected to a continuous treatment with a solution containing copper(I) ions, substantial wiping and/or squeezing to remove excess solution, and then to a heat treatment above 60° C., which is followed by further wash processes, finishing, and the final drying stage.

6. The process as claimed in claim 1, wherein the solution containing copper(I) ions is continually generated and replenished by mixing approximately stoichiometric amounts of a solution containing copper(II) ions with an aqueous solution containing a reducing agent.

7. The process as claimed in claim 4, wherein a solution of copper(II) sulfate in water is used as the solution containing copper(II) ions and a solution of aldehyde sulfoxylate, in water is used as the solution containing reducing agent.

8. The process as claimed in claim 1, wherein before a first treatment at temperatures above 100° C. or a first drying stage the tows or bundles are not only continually treated with an aqueous solution containing copper(I) ions but also, concurrently or subsequently, with a solution of an anionic dyestuff.

* * * * *

UNITED STATES PATENT AND TRADEMARK OFFICE

CERTIFICATE OF CORRECTION

PATENT NO. : 4,507,257

DATED : March 26, 1985

INVENTOR(S) : FESTER ET AL

It is certified that error appears in the above-identified patent and that said Letters Patent is hereby corrected as shown below:

In column 7, line 17 (the ninth line of claim 1), insert -- or -- after the word "stage".

In column 8, line 6 (the second line of claim 4), for "creatment" read -- treatment --.

Signed and Sealed this

*Third* Day of *September 1985*

[SEAL]

*Attest:*

DONALD J. QUIGG

*Attesting Officer* *Acting Commissioner of Patents and Trademarks - Designate*